United States Patent [19]

Kuehn et al.

[11] 4,357,217

[45] Nov. 2, 1982

[54] THREE COMPARTMENT ELECTROLYTIC CELL METHOD FOR PRODUCING HYDROGEN PEROXIDE

[75] Inventors: Christa G. Kuehn, Irvine; Frederic Leder, Corona Del Mar, both of Calif.

[73] Assignee: Occidental Research Corporation, Irvine, Calif.

[21] Appl. No.: 307,926

[22] Filed: Oct. 2, 1981

[51] Int. Cl.[3] ..... C25B 1/30

[52] U.S. Cl. ..... 204/84; 204/180 P; 204/265; 204/98; 204/104

[58] Field of Search ..... 204/82–85, 204/180 P

[56] References Cited

U.S. PATENT DOCUMENTS

| | | | |
|---|---|---|---|
| 3,454,477 | 7/1969 | Grangaard | 204/84 |
| 3,489,665 | 1/1970 | Chandler | 204/180 P |
| 3,523,880 | 8/1970 | Parsi | 204/180 P |
| 3,591,470 | 7/1971 | Grangaard | 204/84 |
| 3,592,749 | 7/1971 | Grangaard | 204/84 |
| 3,607,687 | 9/1971 | Grangaard | 204/84 |
| 3,856,640 | 12/1974 | Halfar et al. | 204/84 |
| 3,884,777 | 5/1975 | Harke et al. | 204/84 |
| 3,884,778 | 5/1975 | Eng et al. | 204/84 |

FOREIGN PATENT DOCUMENTS

| | | | |
|---|---|---|---|
| WO79/00347 | 6/1979 | PCT Int'l Appl. | 204/84 |

*Primary Examiner*—T. Tung

*Attorney, Agent, or Firm*—Walter A. Hackler

[57] ABSTRACT

Apparatus and method for the production of hydrogen peroxide in either a neutral, acidic or an alkaline solution utilizes a three compartment cell having an acid resistant anode, a gas-diffusion cathode, and both an anion and a cation membrane. Acid electrolyte is introduced between the anode and the cation membrane while a basic electrolyte is introduced between the cathode and the anion membrane. A neutral, acidic, or basic solution is introduced between the anion and cation membrane wherein hydrogen ions generated passing through the cation membrane and $O_2H^-$ ions passing through the anion membrane react to form hydrogen peroxide.

9 Claims, 2 Drawing Figures

THREE COMPARTMENT ELECTROLYTIC CELL METHOD FOR PRODUCING HYDROGEN PEROXIDE

The present invention relates to the preparation of hydrogen peroxide in an electrolytic cell and more particularly to a process and apparatus for enabling electrolytic production of hydrogen peroxide of high concentration in acidic, basic and neutral medias.

Hydrogen peroxide is an effective oxidizing and bleaching agent having application in many industries and has widespread use because the reaction product, water, is non-polluting. This latter aspect is becoming more important because of changing environmental attitudes throughout the world.

Electrochemically produced hydrogen peroxide in alkaline solutions may be used in many bleaching operations such as in paper and wood pulp processing plants. Although a two percent alkaline solution of hydrogen peroxide is usable directly in the paper and wood pulp industry, higher concentrations of hydrogen peroxide in acidic or neutral media are desirable in other applications.

Typically, higher concentrations of hydrogen peroxide are produced from the steam distillation of an acid media having a low concentration of hydrogen peroxide. There is need for a method and apparatus capable of producing hydrogen peroxide in an alkaline solution at concentrations suitable for the paper and wood pulp industry as well as producing hydrogen peroxide in acid and neutral media suitable for steam distillation. In addition, such apparatus should be amenable to on-site installations in order to reduce the loss of the relatively unstable hydrogen peroxide by decomposition during storage or shipment.

It should be appreciated that if steam distillation is utilized to produce concentrated hydrogen peroxide, the greater the percentage of hydrogen peroxide in the media being distilled, the less distillation required to reach the desired concentration of hydrogen peroxide and hence, the less energy required.

In the present invention, hydrogen peroxide alkaline solutions may be produced directly in an on-site electrochemical cell which can be used in the paper and wood pulp industry directly. On the other hand, hydrogen peroxide in an acid or neutral media may be produced which is suitable for steam distillation. Concentrated hydrogen peroxide produced in this manner utilizing the present invention uses less energy because high concentrations of peroxide may be produced by the method and apparatus of the present invention.

SUMMARY OF THE INVENTION

A method for producing hydrogen peroxide in accordance with the present invention includes the steps of: introducing an acidic aqueous anolyte between an acid resistant anode and a first surface of a cation membrane permeable only to positive ions; introducing a basic aqueous catholyte between a first surface of an anion membrane permeable only to negative ions and a first surface on a gas-diffusion cathode; introducing an aqueous solution between a second surface on said cation membrane and a second surface on said anion membrane; introducing oxygen-containing gas to a second surface on said gas-diffusion cathode; and connecting said acid resistant anode and said gas-diffusion cathode with an external power supply.

Apparatus for producing hydrogen peroxide in accordance with the present invention includes an acidic resistant anode, a gas-diffusion cathode, a cation membrane permeable only to positive ions having a first surface thereon facing said acid resistant anode, and an anion membrane permeable only to negative ions having a first surface thereon facing a first surface on said gas-diffusion cathode and a second surface thereon facing a second surface on said cation membrane. Means for passing an acidic aqueous anolyte between the acid resistant anode and the cation membrane first surface are provided along with means for passing an aqueous solution between the cation membrane second surface and the anion membrane second surface and means for passing a basic aqueous catholyte between the gas-diffusion cathode first surface and the anion membrane.

In addition, means are provided for introducing an oxygen-containing gas to a second surface on said gas-diffusion cathode, and for connecting said acid resistant anode and said gas-diffusion cathode with an external power supply.

DETAILED DESCRIPTION

Figure 1:
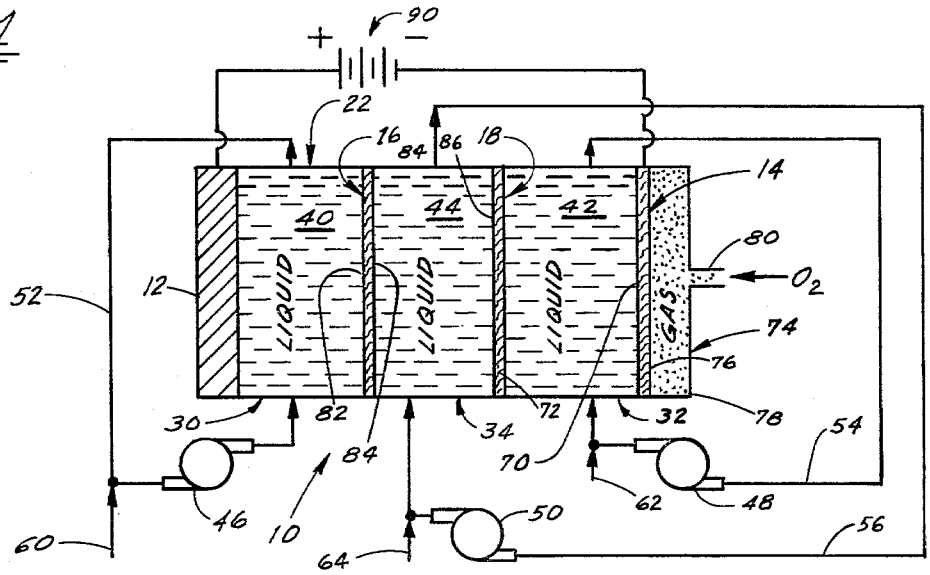
FIG. 1 is a schematic drawing of apparatus suitable for use in the process of the present invention.

Turning now to FIG. 1 there is shown, in schematic form, apparatus 10 for producing hydrogen peroxide which generally includes an acid resistant anode 12, a gas-diffusion cathode 14 a cation membrane 16 and an anion membrane 18 all enclosed in a suitable housing 22 to form an anode compartment 30 cathode compartment 32 and a central compartment 34. It should be appreciated that although a rectangular configuration of the apparatus 10 is shown in FIG. 1 any suitable variation of the apparatus which provides the relationship between the components as illustrated in FIG. 1 may be used in accordance with the present invention. Further, FIG. 1 also illustrates a method for producing hydrogen peroxide using the therein illustrated apparatus.

In order to provide relatively uniform concentrations of an acidic aqueous anolyte 40, a basic aqueous catholyte 42, an aqueous solution 44 within the anode, cathode, and central compartments 30, 32, 34 respectively, pumps 46, 48 and 50 may be provided for circulating or passing the respective electrolytes through the anolyte, catholyte, and central compartments 30, 32, 34, via lines 52, 54 and 56 respectively.

Water may be added to each of the electrolytes 40, 42 and 44 as may be needed to maintain a constant volume thereof by inlets 60, 62 and 64 interconnected with the lines 50, 54 and 56.

More particularly, the anode 12 may be any dimensionally stable anode (DSA) which is stable, or resistant, to acid, particularly sulfuric acid.

Examples of anode material include lead, lead oxide coated graphite, ruthenium oxide, ruthenium oxide coated on titanium, iridium oxide, or iridium oxide coated on titanium, the latter being commercially available from Diamond Shamrock Corporation. The cathode is a gas-diffusion cathode which may be formed from carbon and Teflon binder as is well known in the art. The cathode chamber is in part formed between a first surface 70 on the gas-diffusion cathode 14 and first surface 72 on the anion membrane 18. A chamber 74 is formed, in part, between a second surface 76 on the gas-diffusion cathode and a portion 78 of the housing 22 which includes an inlet 80 thereon which provides a means for introducing an oxygen containing gas to the second surface 76 on the gas-diffusion cathode 14.

The anode compartment is formed, in part, between the anode 12 and the first surface 82 of the cation membrane while the central compartment 44 is formed, in part, between a second surface 84 on the cation membrane and a second surface 86 on the anion membrane 18.

The cation membrane is permeable only by positive ions and may be formed from Nafion 415 which is available from E. I. duPont deNemours and Company and the anion exchange membrane is permeable only to negative ions and may be formed of Ionac MA 3148 or Rai Permion 4035 which are available from Ionac Corporation, Birmingham, N.J. or Rai Research Corporation, Hauppauge, Long Island, N.Y., respectively. An acid anolyte such as a sulfuric acid solution may be used while the basic catholyte may be either sodium hydroxide or potassium hydroxide. The aqueous solution in the central compartment 34 may be neutral, acidic, or basic, preferrably however, the solution is sulfuric acid in the range of 0.1 molar $H_2SO_4$ to approximately 1.0 molar $H_2SO_4$. The concentration of the sulfuric acid is dependent in part upon the thickness of the center compartment 34.

It should be appreciated that the schematic diagram of the method and apparatus shown in FIG. 1 is not to scale and that the central compartment will be very thin with respect to the anolyte and catholyte compartments 30, 32. The concentration of the aqueous electrolyte 44 in the central compartment will depend in part upon the thickness of the compartment in order to lower the resistance across the cell from the anode 12 to the cathode 14. It has been found that thin (less than 0.125 inches) center compartments can produce more concentrated hydrogen peroxide solutions than thick center compartments.

In operation, the anode 12 and cathode 14 are interconnected to an external power supply for causing oxygen to be reduced at the gas-diffusion cathode to produce peroxide ions ($O_2H^-$) within the basic aqueous catholyte 42 in accordance with the reaction, $$O_2+2e^-+H_2O \rightarrow HO_2^-+OH^- \quad (1),$$

and water in the acidic aqueous anolyte to be oxidized to produce hydrogen ions ($H^+$) within the acidic aqueous anolyte in accordance with the reaction, $$H_2O \rightarrow \tfrac{1}{2}O_2+2e^-+2H^+ \quad (2).$$

An electrical field between the anode and the cathode and through the compartments 40, 42, 44 supplied by the external power supply 90 causes hydrogen ions produced within the acidic aqueous anolyte 42 to migrate through the cation membrane and into the central compartment 44 while peroxide ions produced within the catholyte 42 migrate through the anion membrane 18 into the aqueous solution 44, whereupon the hydrogen ions, peroxide ions, and the hydroxide ions of the center compartment combine to form water and hydrogen peroxide therein, in accordance with the equation $$HO_2^-+OH^-+2H^+ \rightarrow H_2O+H_2O_2 \quad (3).$$

It should be appreciated that the hereinabove recited apparatus and method produces hydrogen peroxide that is $H_2O_2$ and not peroxide ion ($HO_2^-$) solutions directly from the reductions of oxygen. On the other hand, if a basic aqueous solution is used in the center compartment 34, peroxide ion $HO_2^-$ will be produced therein.

Thus, high concentrations of hydrogen peroxide are formed in the central compartment and not in contact with an electrode surface where further reduction or oxidation of hydrogen peroxide may be possible. Because of this isolation of the hydrogen peroxide from both the anode and the cathode, a greater concentration hydrogen peroxide is possible at high current efficiency.

The following example is presented by way of illustration only, and is not to be considered limiting to the present invention.

EXAMPLE

An electrolytic cell was constructed in accordance to the schematic diagram shown in FIG. 1, in which the anode, cathode and membranes were of a circular configuration and held in a spaced apart relationship. The cathode comprised Vulcan XC-72 carbon black and Teflon in the porous configuration as is well known in the art, and had a radius of approximately 2.5 inches. The DSA comprised ruthenium oxide available from Diamond Shamrock Corporation and had a radius of approximately 2.5 inches. The cation membrane was formed from Nafion 415 and was approximately 0.012 inches thick while the anion membrane was formed from Ionac MA 3148 and had a thickness of approximately 0.013 inches.

The cell was assembled with the cation membrane spaced apart from the anode approximately 1/16 of an inch, the anion membrane spaced apart from the cathode approximately 5/16 of an inch and the cation and anion membranes spaced approximately ⅛ of an inch from each other. Approximately 200 milliliters of 0.5 M potassium hydroxide solution was circulated through the cathode compartment, approximately 100 milliliters of 1.0 M sulfuric acid solution was circulated through the anode compartment while 100 milliliters of 0.1–1 M sulfuric acid solution was circulated to the central compartment, all electrolytes being circulated at approximately 120 milliliters per minute.

The current through the cells is regulated at approximately 5 amperes at a cell voltage of approximately 4.5 to 7 volts which yielded an anode current density of approximately 394 amps/m$^2$ and a cathode current density of approximately 488 amps/m$^2$. Oxygen was introduced to the gas-diffusion cathode at 0.17 psi.

Figure 2:
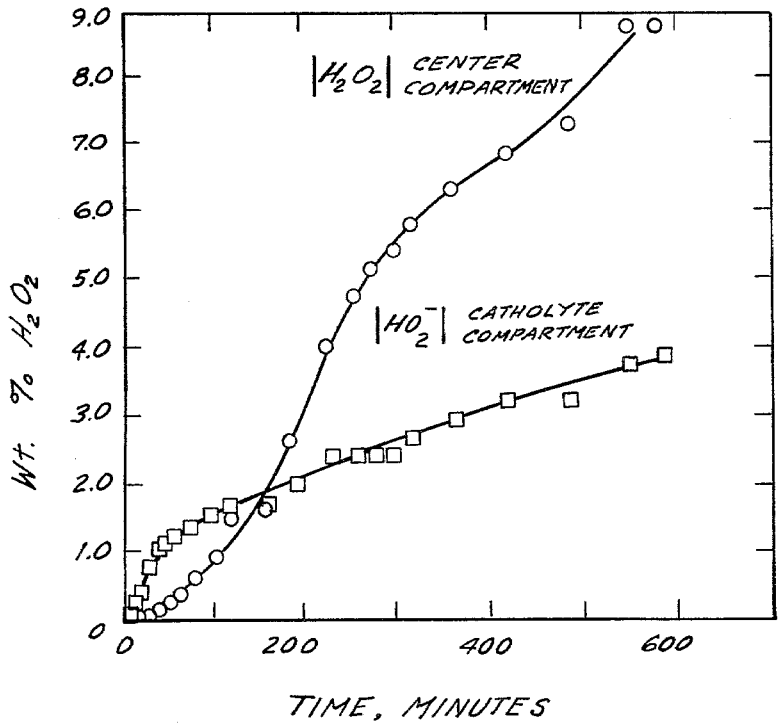
FIG. 2 is a plot of the weight percent of hydrogen peroxide as a function of time produced by a method of the present invention.

FIG. 2 shows the weight percent peroxide in the central compartment as well as in the cathode compartment as a function of time of the electrolytes in the central and cathode compartments respectively, in minutes.

It is apparent that the concentration of peroxide in the catholyte increases up to approximately 2% and thereafter levels off, while the concentration of peroxide in the center compartment increases steadily to approximately 9%.

Although there has been described hereinabove a specific method and arrangement of apparatus for the production of hydrogen peroxide in accordance with the invention for purposes of illustrating the manner in which the invention may be used to advantage it will be appreciated that the invention is not limited thereto.

Accordingly, any and all modifications, variations or equivalent methods and arrangements which may occur to those skilled in the art should be considered to be within the scope of the invention as defined in the appended claims.

What is claimed is:

1. A method for producing hydrogen peroxide comprising the steps of:

(a) introducing an acidic aqueous anolyte between an acid resistant anode and a first surface of a cation membrane permeable only to positive ions;

(b) introducing a basic aqueous catholyte between a first surface of an anion membrane permeable only to negative ions and a first surface on a gas-diffusion cathode;

(c) introducing an aqueous solution between a second surface on said cation membrane and a second surface on said anion membrane;

(d) introducing oxygen-containing gas to a second surface on said gas-diffusion cathode;

(e) connecting said acid resistant anode and said gas-diffusion cathode with an external power supply for causing, (i) the oxygen to be reduced at said diffusion cathode to produce $O_2H^-$ ions within said basic aqueous catholyte, (ii) the water in said acidic aqueous anolyte to be oxidized to produce hydrogen ions ($H^+$), within said acidic aqueous anolyte, and (iii) the hydrogen ions ($H^+$) to move through the cation membrane from the acidic aqueous anolyte to the aqueous solution and the $O_2H^-$ ions to move through the anion membrane from the basic aqueous catholyte to the aqueous solution whereupon said hydrogen ions ($H^+$) react with the $HO_2^-$ ions to produce hydrogen peroxide within said aqueous solution; and, (f) withdrawing aqueous solution and hydrogen peroxide from between the anion membrane second surface and the cation membrane second surface.

2. A method for producing hydrogen peroxide comprising the steps of:

(a) introducing an acidic aqueous anolyte between an acid resistant anode and a first surface of a cation membrane permeable only to positive ions;

(b) introducing a basic aqueous catholyte between a first surface of an anion membrane permeable only to negative ions and a first surface on a gas-diffusion cathode;

(c) introducing an acidic aqueous solution between a second surface on said cation membrane and a second surface on said anion membrane;

(d) introducing oxygen-containing gas to a second surface on said gas-diffusion cathode;

(e) connecting said acid resistant anode and said gas-diffusion cathode with an external power supply for causing, (i) the oxygen to be reduced at said diffusion cathode to produce $O_2H^-$ ions within said basic aqueous catholyte, (ii) the water in said acidic aqueous anolyte to be oxidized to produce hydrogen ions ($H^+$) within said acidic aqueous anolyte, and (iii) the hydrogen ions ($H^+$) to move through the cation membrane from the acidic aqueous anolyte to the acidic aqueous solution and the $O_2H^-$ ions to move through the anion membrane from the basic aqueous catholyte to the acidic aqueous solution whereupon said hydrogen ions ($H^+$) react with the $HO_2^-$ ions to produce hydrogen peroxide within said acidic aqueous solution; and, (f) withdrawing acidic aqueous solution and hydrogen peroxide from between the anion membrane second surface and the cation membrane second surface.

3. A method for producing hydrogen peroxide comprising the steps of:

(a) introducing an acidic aqueous anolyte between an acid resistant anode and a first surface of a cation membrane permeable only to positive ions;

(b) introducing a basic aqueous catholyte between a first surface of an anion membrane permeable only to negative ions and a first surface on a gas-diffusion cathode;

(c) introducing a basic aqueous solution between a second surface on said cation membrane and a second surface on said anion membrane;

(d) introducing oxygen-containing gas to a second surface on said gas-diffusion cathode;

(e) connecting said acid resistant anode and said gas-diffusion cathode with an external power supply for causing, (i) the oxygen to be reduced at said diffusion cathode to produce $O_2H^-$ ions within said basic aqueous catholyte, (ii) the water in said acidic aqueous anolyte to be oxidized to produce hydrogen ions ($H^+$) within said acidic aqueous anolyte, and (iii) the hydrogen ions ($H^+$) to move through the cation membrane from the acidic aqueous anolyte to the basis aqueous solution and the $O_2H^-$ ions to move through the anion membrane from the basic aqueous catholyte to the basic aqueous solution whereupon said hydrogen ions ($H^+$) react with the $HO_2^-$ ions to produce hydrogen peroxide within said basic aqueous solution; and, (f) withdrawing basic aqueous solution and hydrogen peroxide from between the anion membrane second surface and the cation membrane second surface.

4. A method for producing hydrogen peroxide comprising the steps of:

(a) passing an acidic aqueous anolyte between an acid resistant anode and a first surface of a cation membrane permeable only to positive ions;

(b) passing a basic aqueous catholyte between a first surface of an anion membrane permeable only to negative ions and a first surface on a gas-diffusion cathode;

(c) passing an acidic aqueous solution between a second surface on said cation membrane and a second surface on said anion membrane;

(d) introducing oxygen-containing gas to a second surface on said gas-diffusion cathode; and, (e) connecting said acid resistant anode and said gas-diffusion cathode with an external power supply for causing, (i) the oxygen to be reduced at said diffusion cathode to produce $O_2H^-$ ions within said basic aqueous catholyte, (ii) the water in said acidic aqueous anolyte to be oxidized to produce hydrogen ions ($H^+$) within said acidic aqueous anolyte, and (iii) the hydrogen ions ($H^+$) to move through the cation membrane from the acidic aqueous anolyte to the acidic aqueous solution and the $O_2H^-$ ions to move through the anion membrane from the basic aqueous catholyte to the acidic aqueous solution whereupon said hydrogen ions ($H^+$) react with the $HO_2^-$ ions to produce hydrogen peroxide within said aqueous solution.

5. The method of claim 4, wherein the acidic aqueous anolyte comprises approximately 1.0 molar sulfuric acid, the basic aqueous catholyte comprises approximately 0.5 molar potassium hydroxide and the acidic aqueous solution comprises approximately 0.1 to approximately 1.0 molar sulfuric acid.

6. The method of claim 5, wherein the sulfuric acid aqueous anolyte is circulated between the acid resistant anode and the cation membrane first surface, the potassium hydroxide catholyte is circulated between the gas-diffusion cathode and the anion membrane first surface, and the sulfuric acid aqueous solution is circulated between the cation membrane second surface and the anion membrane second surface.

7. A method for producing hydrogen peroxide comprising the steps of:

(a) passing a sulfuric acid aqueous anolyte between an acid resistant anode and a first surface of a cation membrane permeable only to positive ions;

(b) passing sodium hydroxide aqueous catholyte between a first surface of an anion membrane permeable only to negative ions and a first surface on a gas-diffusion cathode;

(c) passing a sulfuric acid aqueous solution between a second surface on said cation membrane and a second surface on said anion membrane;

(d) introducing oxygen-containing gas to a second surface on said gas-diffusion cathode;

(e) connecting said acid resistant anode and said gas-diffusion cathode with an external power supply for causing, (i) the oxygen to be reduced at said diffusion cathode to produce $O_2H^-$ ions within said sodium hydroxide aqueous catholyte, (ii) the water in said sulfuric acid aqueous anolyte to be oxidized to produce hydrogen ions ($H^+$) within said sulfuric acid aqueous anolyte, and (iii) the hydrogen ions ($H^+$) to move through the cation membrane from the sulfuric acid anolyte to the sulfuric acid aqueous solution and the $O_2H^-$ ions to move through the anion membrane from the sodium hydroxide aqueous catholyte to the sulfuric acid aqueous solution whereupon said hydrogen ions ($H^+$) react with the $HO_2^-$ ions to produce hydrogen peroxide within said sulfuric acid aqueous solution; and, (f) withdrawing sulfuric acid aqueous solution and hydrogen peroxide from between the anion membrane second surface and the cation membrane second surface.

8. A method for producing hydrogen peroxide comprising the steps of:

(a) passing a sulfuric acid aqueous anolyte between an acid resistant anode and a first surface of a cation membrane permeable only to positive ions;

(b) passing a potassium hydroxide aqueous catholyte between a first surface of an anion membrane permeable only to negative ions and a first surface on a gas-diffusion cathode;

(c) passing a sulfuric acid aqueous solution between a second surface on said cation membrane and a second surface on said anion membrane;

(d) introducing oxygen-containing gas to a second surface on said gas-diffusion cathode;

(e) connecting said acid resistant anode and said gas-diffusion cathode with an external power supply for causing, (i) the oxygen to be reduced at said diffusion cathode to produce $O_2H^-$ ions within said potassium hydroxide aqueous catholyte, (ii) the water in said sulfuric acid aqueous anolyte to be oxidized to produce hydrogen ions ($H^+$) within said sulfuric acid aqueous anolyte, and (iii) the hydrogen ions ($H^+$) to move through the cation membrane from the sulfuric acid aqueous anolyte to the sulfuric acid aqueous solution and the $O_2H^-$ ions to move through the anion membrane from the potassium hydroxide aqueous catholyte to the sulfuric acid aqueous solution whereupon said hydrogen ions ($H^+$) react with the $HO_2^-$ ions to produce hydrogen peroxide within said sulfuric acid aqueous solution;

(f) circulating the sulfuric acid solution between the anion membrane second surface and the cation membrane; and, (g) withdrawing the sulfuric acid aqueous solution and hydrogen peroxide from between the anion membrane second surface and the cation membrane second surface.

9. A method for producing hydrogen peroxide comprising the steps of:

(a) passing a sulfuric acid aqueous anolyte between a dimensionally stable anode and a first surface on a cation membrane permeable only to positive ions, said membrane comprising Nafion 415, said sulfuric acid aqueous anolyte comprises a 1.0 molar solution of sulfuric acid;

(b) passing a potassium hydroxide aqueous catholyte between a first surface of an anion membrane permeable only to negative ions and a first surface on a gas-diffusion cathode, said potassium hydroxide aqueous catholyte comprising a 0.5 molar solution of potassium hydroxide, said gas-diffusion cathode comprising carbon black;

(c) introducing a 1.0 molar sulfuric acid aqueous solution between a second surface on said cation membrane and a second surface on said anion membrane;

(d) introducing oxygen-containing gas to a second surface on said gas-diffusion cathode, oxygen in said oxygen-containing gas diffusing through the gas-diffusion cathode from the second surface thereon to the first surface thereon;

(i) the oxygen to be reduced at said diffusion cathode to produce $O_2H^-$ ions within said potassium hydroxide aqueous catholyte, (ii) the water in said sulfuric acid aqueous anolyte to be oxidized to produce hydrogen ions ($H^+$) within said sulfuric acid aqueous anolyte, and (iii) the hydrogen ions ($H^+$) to move through the cation membrane from the sulfuric acid aqueous anolyte to the sulfuric acid aqueous solution and $O_2H^-$ ions to move through the anion membrane from the basic aqueous catholyte to the sulfuric acid aqueous solution whereupon said hydrogen ions ($H^+$) react with the $HO_2^-$ ions to produce hydrogen peroxide within said sulfuric acid aqueous solution;

(f) circulating the sulfuric acid aqueous anolyte between the dimensionally stable anode and the anion membrane first surface;

(g) circulating the potassium hydroxide aqueous catholyte between the gas-diffusion cathode and the cation membrane first surface;

(h) circulating the sulfuric acid aqueous solution between the anion membrane second surface and the cation membrane second surface; and, (i) withdrawing the sulfuric acid aqueous solution and hydrogen peroxide from between the anion membrane second surface and the cation membrane second surface.

* * * * *